US006135812A

United States Patent [19]

Harting et al.

[11] Patent Number: 6,135,812

[45] Date of Patent: Oct. 24, 2000

[54] ELECTRICAL CONTACT ELEMENT

[75] Inventors: Dietmar Harting, Espelkamp; Günter Pape, Enger; Manfred Berghorn, Stozenau, all of Germany

[73] Assignee: Harting KGaA, Espelkamp, Germany

[21] Appl. No.: 09/188,663

[22] Filed: Nov. 9, 1998

[30] Foreign Application Priority Data

Nov. 12, 1997 [DE] Germany ..... 197 49 890

[51] Int. Cl.[7] ..... H01R 13/73

[52] U.S. Cl. ..... 439/560; 439/741; 439/743; 439/84; 411/48

[58] Field of Search ..... 439/733.1, 544, 439/560, 555, 741, 743, 924, 567, 568, 84; 411/41, 45, 46, 48, 57.1, 60.1

[56] References Cited

U.S. PATENT DOCUMENTS

| | | | |
|---|---|---|---|
| 2,972,727 | 2/1961 | Flanagan, Jr. et al. | 439/84 |
| 3,244,801 | 4/1966 | Dozier | 439/741 |
| 3,446,908 | 5/1969 | Tally et al. | 439/84 |
| 3,504,328 | 3/1970 | Olsson | 439/84 |
| 4,690,481 | 9/1987 | Randolph | 439/555 |
| 5,082,460 | 1/1992 | Legrady | 439/84 |
| 5,163,795 | 11/1992 | Benoit et al. | 411/45 |
| 5,211,519 | 5/1993 | Saito | 411/45 |
| 5,290,137 | 3/1994 | Duffy, Jr. | 411/41 |
| 5,375,954 | 12/1994 | Eguchi | 411/48 |

FOREIGN PATENT DOCUMENTS

| | | |
|---|---|---|
| 1 415 642 | 11/1975 | United Kingdom . |
| 1 591 574 | 6/1981 | United Kingdom . |

*Primary Examiner*—Paula Bradley
*Assistant Examiner*—Katrina Davis
*Attorney, Agent, or Firm*—McEachran, Jambor, Keating, Bock & Kurtz

[57] ABSTRACT

For an electrical contact element with a securing end for securing in an opening of a support plate, it is proposed to provide the securing end with a central bore and with axial slots, elastic tongues being formed, and to introduce a pressure element into the bore, the tongues being forced radially outward against the wall of the support plate opening as the pressure element is pressed into the bore.

12 Claims, 8 Drawing Sheets

ELECTRICAL CONTACT ELEMENT

The invention relates to an electrical contact element with a securing end for securing in an opening of a support plate.

Contact elements of this type, which can be constructed as solid high-current contacts or as coaxial contacts, are pressed for a plug-like connection with corresponding plug contacts into openings of a support plate. In this respect, it is necessary to provide a mechanically stable seat of the contact elements in the support plate and optionally also an efficient electrical connection of the contact element with the support plate or the copper coating/conductor path thereof.

It is known to provide electrical contact elements with a securing end constructed as a press-in section. In this respect, it is known to provide the press-in section with a knurling or to construct the press-in section so that it is elastically deformable in its entirety.

However, high pressing forces are required in order to press the contact elements into the support plate. Furthermore, relatively small tolerances are required for the diameter of the opening and for the press-in section in order to fulfill the requirements of mechanical and electrical stability.

SUMMARY OF THE INVENTION

It is the object of the invention to construct a contact element of the initially stated type in such a manner that the required pressing or assembly forces are reduced and the tolerances which are to be observed are as large as possible.

This object is achieved in that the securing end is provided with a central bore, the securing end is provided with axial slots, elastic tongues being formed, and a pressure element can be introduced into the bore, the tongues being forced radially outwards as the pressure element is pressed in.

Advantageous developments of the invention are contained in claims 2 to 7.

A further solution of the object consists in that the securing end comprises a solid, cylindrical region, the pressure element is constructed as a sleeve with axial slots forming elastic tongues, the sleeve can be inserted into the opening of the support plate, and as the securing end is pushed into the sleeve the cylindrical region acts upon the tongues in such a manner that these are forced radially outwards.

Advantageous developments of this solution are contained in claims 9 to 12.

The advantages attained by way of the invention in an embodiment where the contact element is constructed as a solid high-current contact consist in particular in that the pressing or assembly forces of the contact element acting upon the support plate are extremely low but a perfect mechanically and electrically stable securing of the contact element is nevertheless attained.

In an embodiment of the contact element as a coaxial contact, the same advantages are attained, but in addition the coaxial contact element has a simple structure, is made of a small number of preassembled individual parts and can therefore be manufactured economically.

BRIEF DESCRIPTION OF THE DRAWINGS

An embodiment of the invention is illustrated in the drawings and described in further detail in the following. In the drawings.

DESCRIPTION OF THE PREFERRED EMBODIMENT

Figure 2:
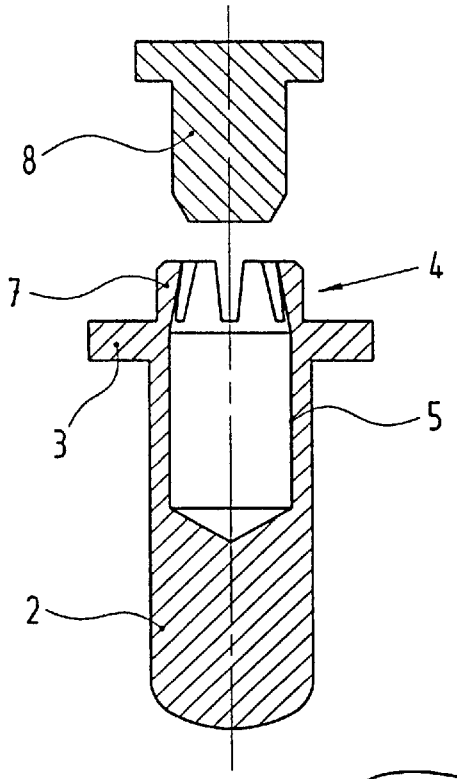
FIGS. 1, 2 show a contact element constructed as a solid contact prior to insertion into a support plate.
Figure 1:
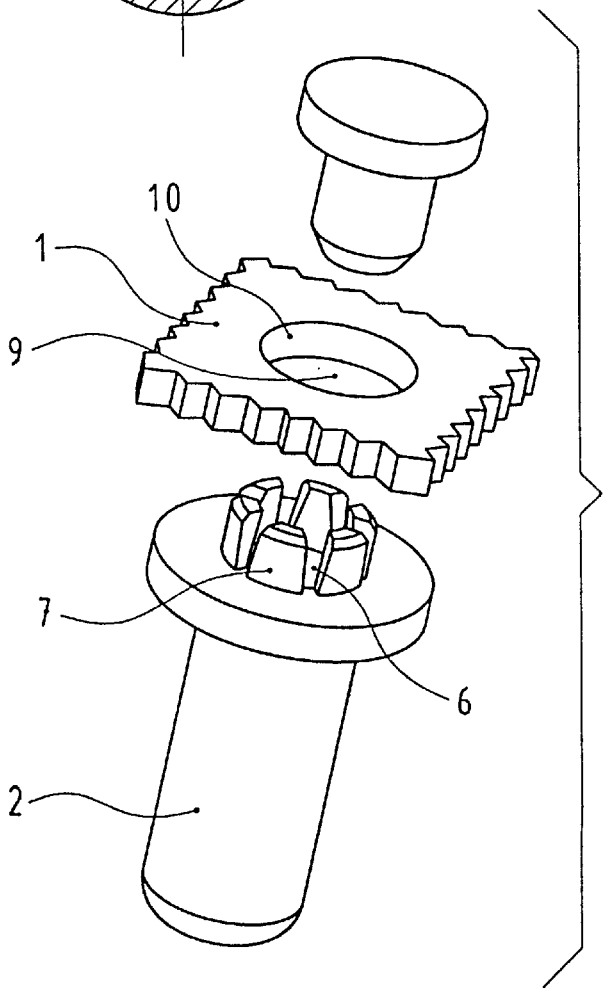
Figure 4:
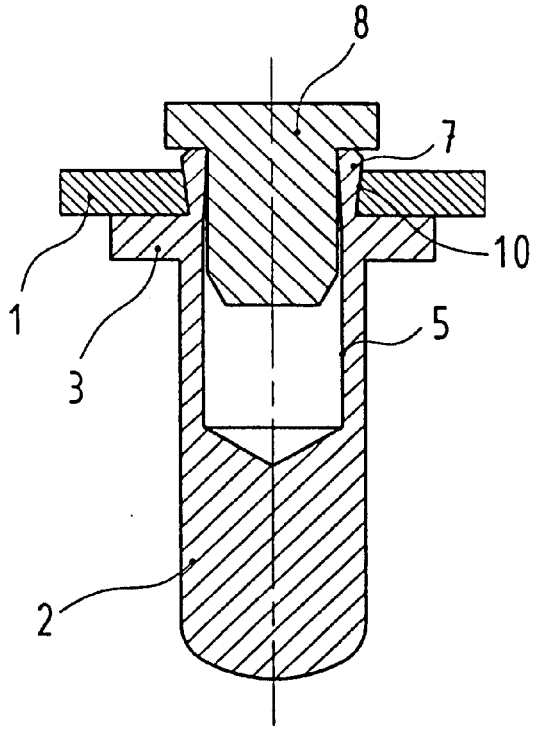
FIGS. 3, 4 show the contact element according to FIGS. 1, 2 following insertion into the support plate.
Figure 3:
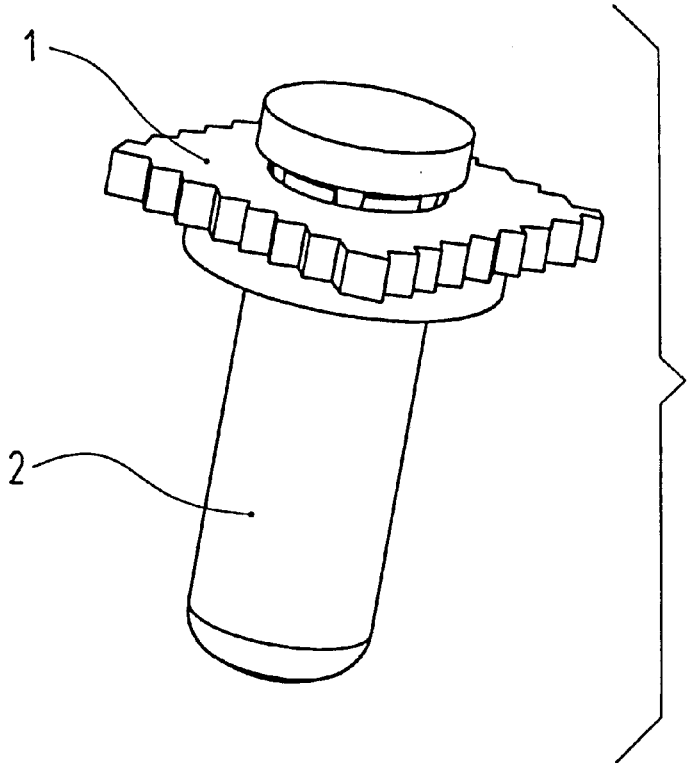

FIGS. 1 to 4 show a contact element constructed as a solid or high-current contact, FIGS. 1 and 2 showing the contact element prior to insertion/securing in a support plate 1 and FIGS. 3 and 4 showing the contact element inserted into the support plate.

This contact element essentially comprises a solid rod section 2, which is provided with a collar 3 for limiting the depth of insertion during insertion into the support plate and a securing end 4. The securing end is provided with a bore 5 and axial slots 6, the slots extending from the end of the contact element to the collar. As a result of the slots, elastic tongues 7 are formed on the securing end. A substantially cylindrical pressure element 8 is also provided, whose diameter matches the bore 5 of the securing end, so that it can be pushed into said bore. As shown in FIG. 2, the bore 5 is conical in the region of the securing end, so that the diameter of the bore is reduced in the introduction region. Consequently, the tongues 7 are forced radially outwards as the pressure element is inserted.

In order to secure the contact element in the support plate (cf. FIGS. 3 and 4), the latter is provided with an opening 9, into which the securing end 4 of the contact element can be pushed. Following insertion, the pressure element 8 is pressed into the bore 5, the tongues being forced radially outwards against the wall 10 of the opening 9 of the support plate, and the contact element is securely anchored in the opening.

The support plate can be made of a plastics material if only a securing of the contact element in or on a support plate of this type is required. In cases where an electrically conductive connection of the contact element with the support plate or conductor paths provided thereon is required, then the support plate can also be made of an electrically conductive material or of plastics material with a copper coating. The pressure element can be made of plastics material or a metallic material.

Whilst using the securing technique described above, it can also be provided that the bore 5 in the securing end of the contact element is cylindrical and the pressure element comprises a region with an enlarged diameter, which forces the tongues 7 radially outwards as the pressure element is inserted.

Figure 6:
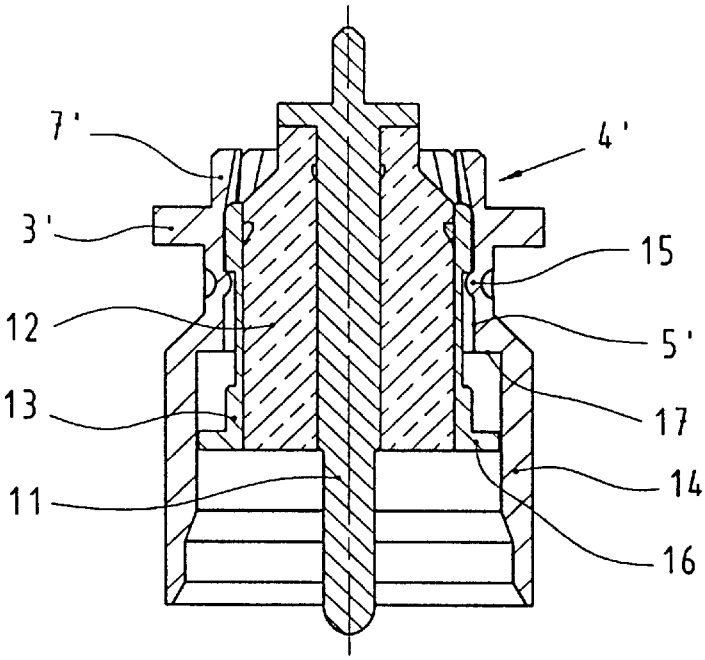
FIGS. 5, 6 show a contact element constructed as a coaxial contact prior to insertion into a support plate.
Figure 5:
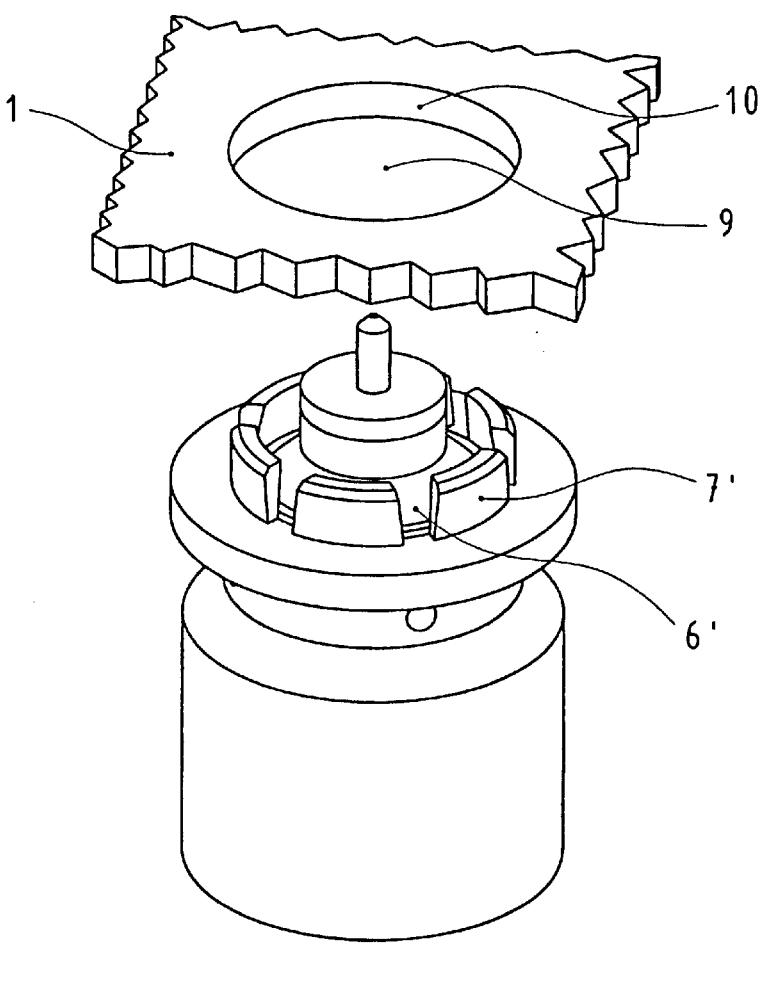
Figure 8:
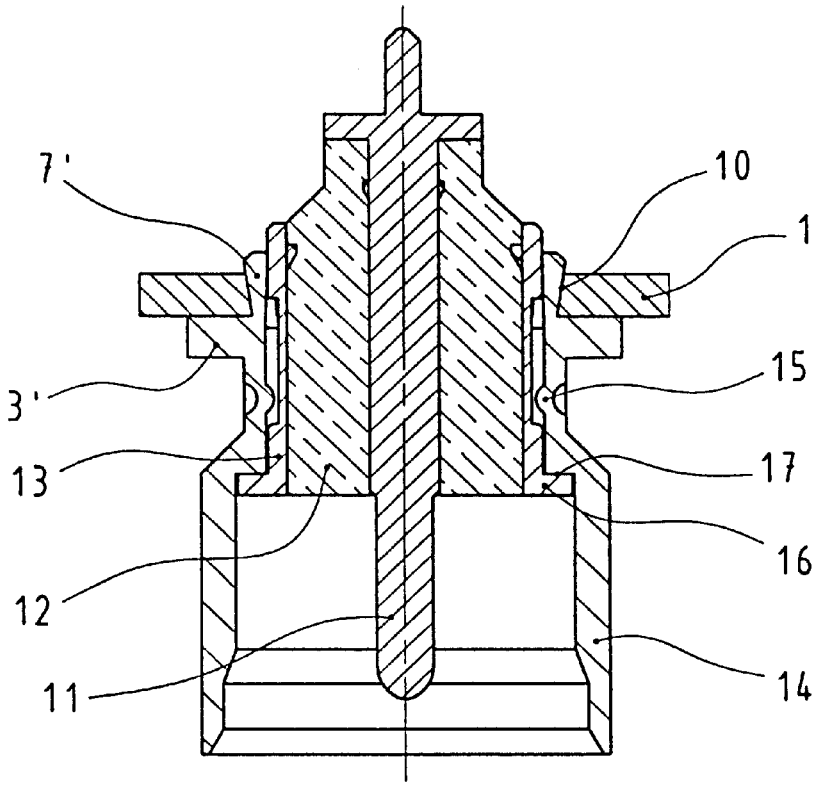
FIGS. 7, 8 show the contact element according to FIGS. 5, 6 following insertion into the support plate.
Figure 7:
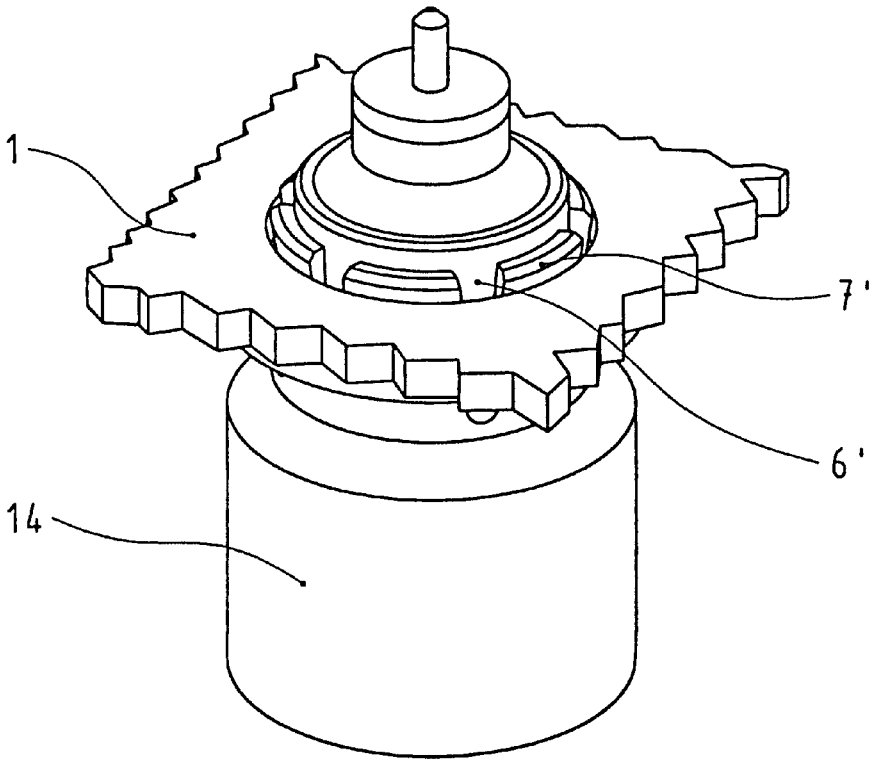

FIGS. 5 to 8 show a modified contact element constructed as a coaxial contact, FIGS. 5 and 6 showing the contact element prior to insertion/securing in the support plate 1 and FIGS. 7 and 8 showing the contact element inserted in the support plate.

This contact element essentially comprises an inner contact part 11, a dielectric sleeve 12, a further sleeve 13 acting as a pressure element and an outer sleeve 14. In this respect, the inner contact part 11 is securely anchored in the dielectric sleeve 12 and the sleeve 13 acting as a pressure element is in turn secured on the dielectric sleeve. The above-mentioned parts form a securely joined unit, which is pushed into the cylindrical bore 5' of the outer sleeve. The outer sleeve is provided at its securing end 4' with axial slots 6', thereby forming elastic tongues 7'. In the region of these tongues, the opening of the outer sleeve 14 is conical, i.e. the tongues are conically shaped on their inner side. This conicity is selected in such a manner that the diameter of the opening is smaller than the outer diameter of the sleeve 13 acting as a pressure element. As a result of this measure it is ensured that the tongues 7' are forced radially outwards as the sleeve 13 is pushed into the opening in the securing end 4'.

Also fitted on the outer sleeve 14 are inwardly pointing projections 15, which act as loss protection for the sleeve 13 constructed as a pressure element and for the parts connected therewith.

As mentioned further above, FIGS. 5 and 6 show the contact element prior to securing to the support plate 1. In order to secure the contact element to the support plate, the securing end 4' of the contact element preassembled according to FIGS., 5, 6 is firstly pushed into the opening 9 of the support plate as far as the circumferential collar 3' acting as an abutment. The sleeve 13 acting as a pressure element is then pressed into the opening of the securing end, the tongues 7' then being forced outwards and being securely pressed against the inner wall 10 of the opening 9 of the support plate. The contact element is thus securely connected to the support plate, as shown in FIGS. 7 and 8.

In this respect, the circumferential collar 3' on the outside of the outer sleeve in the vicinity of the elastic tongues rests fully against the upper surface of the support plate. At its end facing away from the tongues of the outer sleeve, the sleeve 13 constructed as pressure element comprises an outer collar 16, which cooperates with a circumferential edge 17 inside the cylindrical bore of the outer sleeve and acts as an abutment against the outer sleeve, whilst the sleeve 13 constructed as pressure element and the other contact parts connected therewith are displaced from a first (preassembly position) into a second position (securing position) inside the outer sleeve. The inwardly pointing projections 15 provided on the outer sleeve have no function in the second position, since the sleeve 13 acting as pressure element is now mechanically secured in position in the outer sleeve by friction locking in the region of the elastic tongues.

The support plate can be made of metallic material or a circuit board with a metal coating, an electrical connection of the outer sleeve with the support plate or the metal coating thereof then being attained in addition to the mechanical securing.

Figure 10:
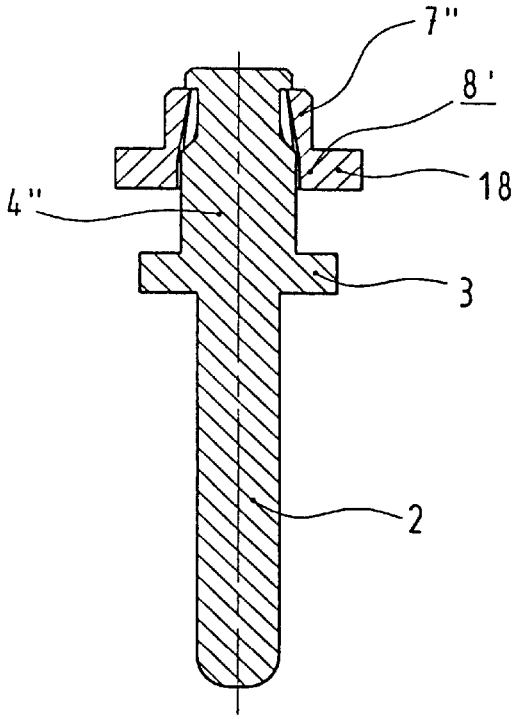
FIGS. 9, 10 show a modified contact element constructed as a solid contact prior to insertion into a support plate.
Figure 9:
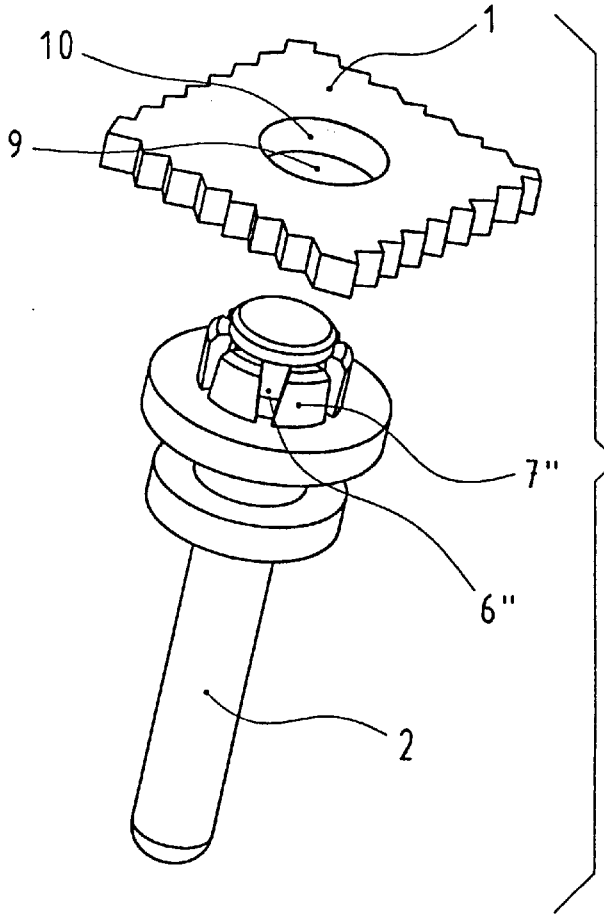
Figure 12:
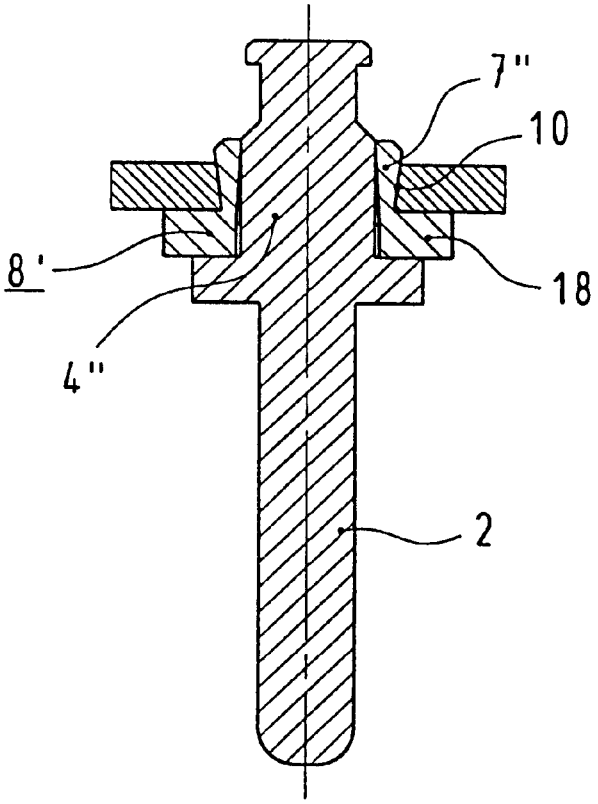
FIGS. 11, 12 show the contact element according to FIGS. 9, 10 following insertion into the support plate.
Figure 11:
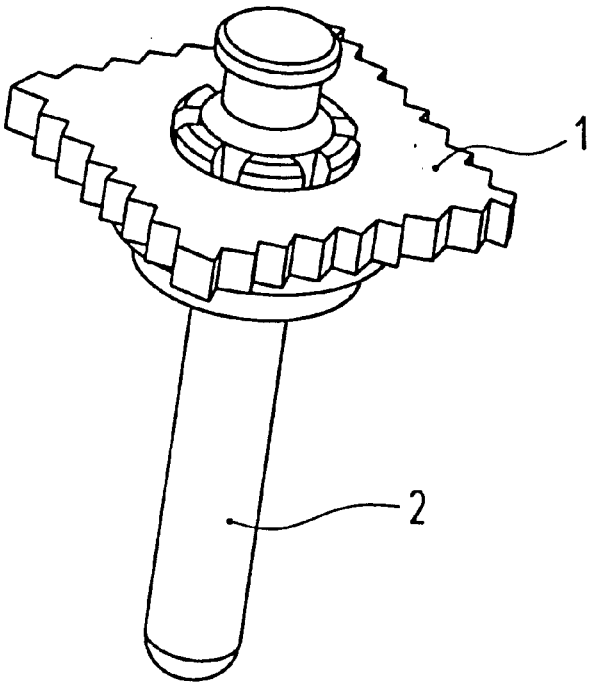
Figure 14:
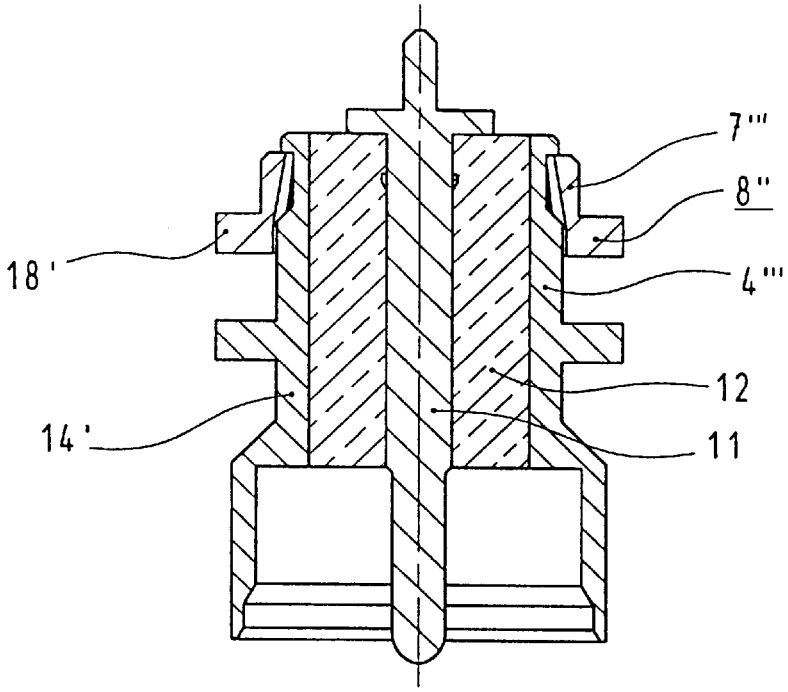
FIGS. 13, 14 show a modified contact element constructed as a coaxial contact prior to insertion into a support plate.
Figure 13:
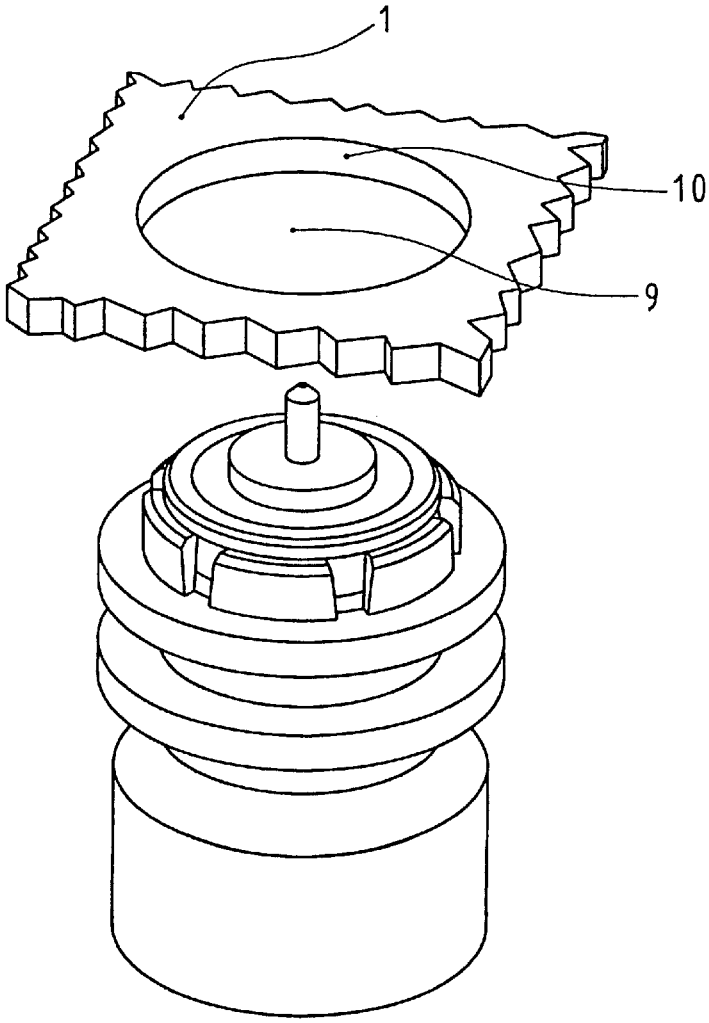

FIGS. 9 to 12 show a contact element constructed as a solid or high-current contact, FIGS. 9 and 10 showing the contact element prior to insertion/securing in the support plate 1 and FIGS. 11 and 12 showing the contact element inserted in the support plate.

In contrast to the contact element described in FIGS. 1 to 4, in this case it is provided that the securing end 4" is solid and non-elastic and a sleeve acting as a pressure element 8' is provided on the securing end. In this respect, the said sleeve is then provided with axial slots 6" to form elastic tongues 7" and the tongues are conical on their inner side.

In order to secure this contact element to the support plate, the sleeve-shaped pressure element is pushed into the opening 9 of the support plate as far as its collar 18 and the cylindrical securing end 4" is then pressed into the pressure element. The elastic tongues are then in turn forced outwards against the wall 10 of the support plate opening 9 and the contact element is securely connected to the support plate.

Figure 16:
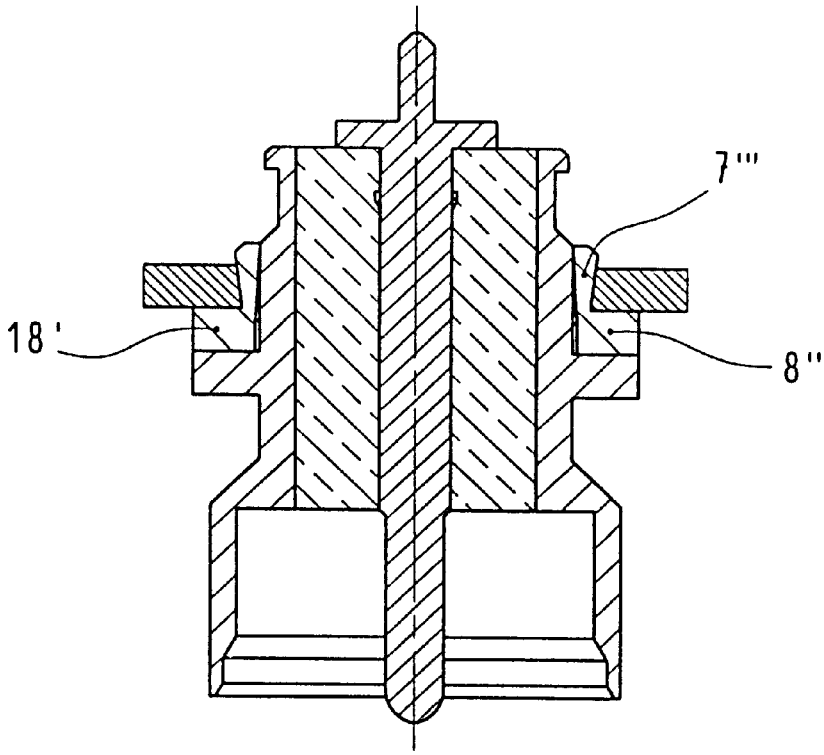
FIGS. 15, 16 show the contact element according to FIGS. 13, 14 following insertion into the support plate.
Figure 15:
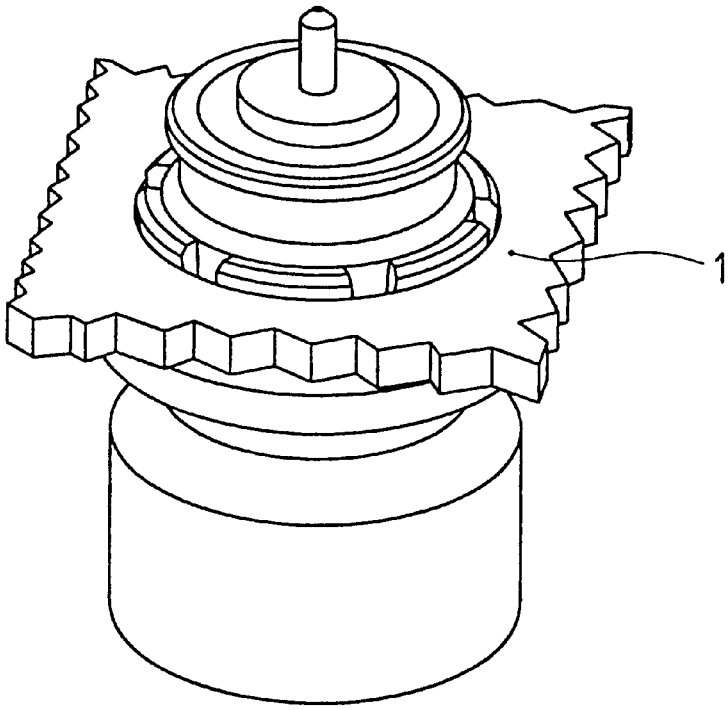

Finally, a contact element constructed as a coaxial contact is shown in FIGS. 13 to 16, FIGS. 13 and 14 again showing the contact element prior to insertion/securing in the support plate 1 and FIGS. 15 and 16 showing the contact element inserted in the support plate.

In contrast to the coaxial contact described in FIGS. 5 to 8, in this case it is provided that the inner contact part 11, secured in the dielectric sleeve 12, is securely anchored in the outer sleeve 14'. The securing end 4'" is substantially cylindrical and non-elastic. However, a sleeve constructed as a pressure element 8" is provided on the securing end. The elastic tongues 7'" are constructed on this sleeve.

In order to secure this contact element to the support plate, the pressure element 8" is pushed into the opening 9 of the support plate as far as its collar 18' and the cylindrical securing end 4'" is then pressed into the pressure element. The elastic tongues are then in turn forced outwards against the wall 10 of the support plate opening 9 and the contact element is securely connected to the support plate.

What is claimed is:

1. Electrical contact element with a securing end for securing in an opening of a support plate, characterized in that the securing end (4) has a central bore (5), axial slots (6) in the securing end (4) peripherally spaced about the central bore (5), elastic tongues (7) being formed between adjacent axial slots (6), said elastic tongues (7) having an inwardly tapered inner surface, and a pressure element (8) for insertion into the bore (5), the pressure element (8) being sized to force the tongues (7) radially outward as the pressure element is pressed in.

2. Electrical contact element according to claim 1, characterized in that the bore (5) is conical in the region of the tongues (7) and the pressure element (8) is cylindrical.

3. Electrical contact element according to claim 1, characterized in that the bore (5) is cylindrical and the pressure element (8) is conical.

4. Electrical contact element according to claim 1, characterized in that the contact element is constructed as a coaxial contact with an inner contact part (11) and an outer sleeve (14), the securing end (4') being provided on the outer sleeve (14) of the contact element, the inner contact part (11) of the contact element is secured in a dielectric sleeve (12), and the pressure element is provided as an axially displaceable sleeve (13) on the dielectric sleeve (12).

5. Electrical contact element according to claim 1, characterized in that the pressure element is made of electrically conductive material.

6. Electrical contact element according to claim 1, characterized in that the contact element is constructed as a coaxial contact with an inner contact part (11) and an outer sleeve (14), the securing end (4') being provided on the outer sleeve (14) of the contact element, the inner contact part (11) of the contact element is secured in a dielectric sleeve (12), a sleeve (13) acting as a pressure element is secured on the dielectric sleeve (12), and the tongues (7') of the securing end (4') are forced radially outward as the sleeve (13) is pressed into the outer sleeve (14).

7. Electrical contact element according to claim 6, characterized in that the sleeve (13) acting as a pressure element is provided with an inner edge (17), which cooperates with a collar (16) in the outer sleeve (14) and limits the depth to which the pressure element can be pressed into the outer sleeve.

8. Electrical contact element with a securing end for securing in an opening of a support plate, characterized in that a sleeve acting as a pressure element (8') is provided on the securing end (4"), the securing end being solid and non-elastic, the sleeve is constructed with axial slots (6") to form elastic tongues (7"), the sleeve can be inserted into the opening (9) of the support plate (1), and as the securing end (4") is pushed into the sleeve it acts upon the tongues (7") in such a manner that said tongues are forced radially outward.

9. Electrical contact element according to claim 8, characterized in that the receiving opening of the sleeve is conical and the securing end (4") is cylindrical.

10. Electrical contact element according to claim 8, characterized in that the receiving opening of the sleeve is cylindrical and the securing end (4") is conical.

11. Electrical contact element according to claim 8, characterized in that the sleeve is made of an electrically conductive material.

12. Electrical contact element according to claim 8, characterized in that the contact element is constructed as a coaxial contact with an inner contact part (11) and an outer sleeve (14), the securing end (4") being provided on the outer sleeve (14') of the contact element, the inner contact part (11) of the contact element is secured in a dielectric sleeve (12), and the outer sleeve (14') is secured on the dielectric sleeve (12).

* * * * *